US008543014B2

(12) United States Patent
Kobuse

(10) Patent No.: US 8,543,014 B2
(45) Date of Patent: Sep. 24, 2013

(54) IMAGE FORMING APPARATUS AND METHOD

(75) Inventor: Osamu Kobuse, Saitama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 271 days.

(21) Appl. No.: 13/049,668

(22) Filed: Mar. 16, 2011

(65) Prior Publication Data

US 2011/0243593 A1 Oct. 6, 2011

Related U.S. Application Data

(60) Provisional application No. 61/321,008, filed on Apr. 5, 2010.

(51) Int. Cl.
*G03G 15/00* (2006.01)
*G03G 15/08* (2006.01)
*G03G 21/18* (2006.01)

(52) U.S. Cl.
USPC ..... 399/12; 399/110; 399/262

(58) Field of Classification Search
USPC ..... 399/12, 30, 110, 111, 262
See application file for complete search history.

(56) References Cited

U.S. PATENT DOCUMENTS 7,429,442 B2 * 9/2008 Honda et al. ..... 399/262 X
7,995,933 B2 * 8/2011 Kondo et al. ..... 399/111 X
2003/0138259 A1 * 7/2003 Watanabe et al. ..... 399/30
2007/0077074 A1 * 4/2007 Adkins et al. ..... 399/12
2008/0273883 A1 * 11/2008 Kim et al. ..... 399/12

FOREIGN PATENT DOCUMENTS

JP 2001-272890 10/2001
JP 2005-141093 6/2005

OTHER PUBLICATIONS

Machine translation of JP 2001-272890 dated Feb. 6, 2013.*
Machine translation of JP 2005-141093 dated on Feb. 6, 2013.*

* cited by examiner

*Primary Examiner* — Sophia S Chen
(74) *Attorney, Agent, or Firm* — Patterson & Sheridan, L.L.P.

(57) ABSTRACT

Certain embodiments provide an image forming apparatus, includes: a photoconductive drum; a developing container having a first chamber that contains a developer made of toner and a toner additive therein, and a receive port that communicates with the first chamber; a developing roller that develops the electrostatic latent image on the photoconductive drum with toner in the developing container; a toner cartridge having a second chamber that contains a supply of toner to the developing container therein, and a discharge port that communicates with the second chamber and transports the supply of toner to the receive port; a storage medium fixed to the toner cartridge, and is rewritable and stores specific data therein; a sensor that detects a toner concentration in the toner cartridge; and a controller that rewrites specific data stored in the storage medium by random data upon detecting the toner empty by the sensor.

14 Claims, 5 Drawing Sheets

IMAGE FORMING APPARATUS AND METHOD

CROSS-REFERENCE TO RELATED APPLICATION

The present application claims priority under 35 U.S.C. 119 to U.S. Provisional Application Ser. No. 61/321,008, to Kobuse, filed on Apr. 5, 2010, the entire disclosure of which is incorporated herein by reference.

TECHNICAL FIELD

Embodiments described herewith relate to an image forming apparatus, a toner cartridge, and a method of processing data recorded in a storage medium.

BACKGROUND

An image forming apparatus using an electrophotography consumes toner. When printing continues, the toner in a toner cartridge is used up someday. Thereafter, a person removes the toner cartridge from a main body of the image forming apparatus. The person sets a fresh toner cartridge filled with toner in the main body.

The toner cartridge fixes an IC (integrated circuit) chip to a wall of a container. The IC chip stores data for detecting that the toner cartridge is genuine goods.

Up to now, the data stored in the IC chip mounted on the toner cartridge is not erased. The IC chip remains fixed on the container. The data is still recorded in the IC chip even at a time when, due to the toner use up, the image forming apparatus is necessary to replace the toner cartridge with a fresh one.

However, that the data remains in the IC chip suffers from such a problem that a manufacturer other than a genuine manufacturer can easily copy the data.

A third party writes copy data on another storage medium. The third party attaches the storage medium onto a toner cartridge different from a genuine toner cartridge.

There is a drawback that the third party can easily copy the toner cartridge usable by an apparatus manufactured by the genuine manufacturer.

DETAILED DESCRIPTION

Certain embodiments provide an image forming apparatus, including: a photoconductive drum on which an electrostatic latent image is formed through an electrophotography; a developing container configured to have a first chamber that contains a developer made of toner and a toner additive therein, and a receive port that communicates with the first chamber; a developing roller configured to develop the electrostatic latent image on the photoconductive drum with toner in the developing container; a toner cartridge configured to have a second chamber that contains a supply of toner to the developing container therein, and a discharge port that communicates with the second chamber and transport the supply of toner to the receive port; a storage medium configured to be fixed to the toner cartridge, and be rewritable and store specific data therein; a sensor configured to detect a toner concentration in the toner cartridge; and a controller configured to rewrite specific data stored in the storage medium by random data upon detecting the toner empty by the sensor.

Hereinafter, a description will be given in detail of an image forming apparatus, a toner cartridge, and a method of processing the data recorded in the storage medium with reference to the accompanying drawings. In the respective drawings, the same parts are indicated by identical symbols, and a repetitive description will be omitted.

First Embodiment

An image forming apparatus according to a first embodiment is directed to an MFP (multifunction peripheral) using an electrophotography.

A toner cartridge according to the first embodiment is directed to a toner cartridge with an IC chip.

A method of processing data according to the first embodiment is directed to a method of erasing specific data recorded in the IC chip of a genuine toner cartridge.

Figure 1:
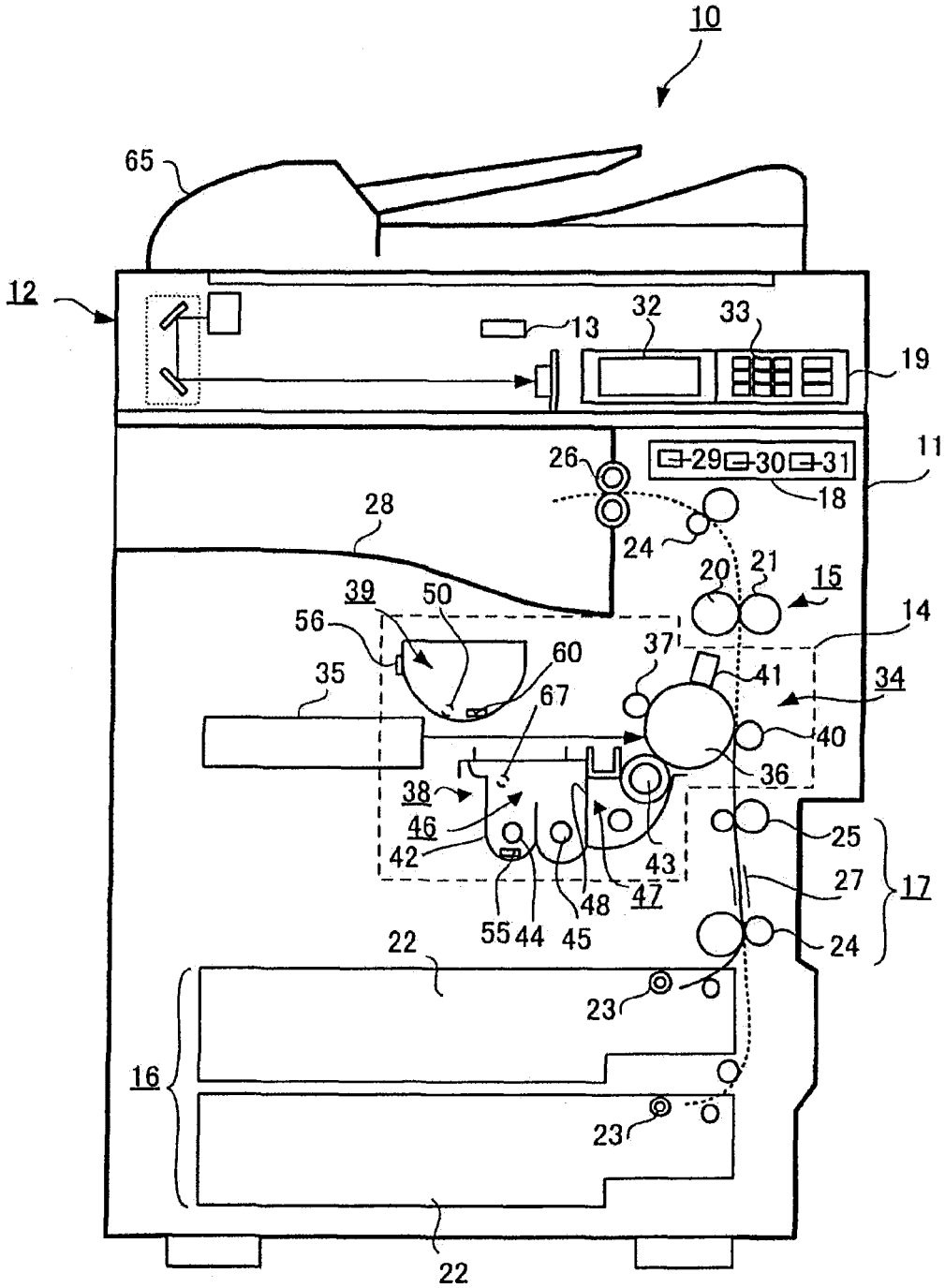
FIG. 1 is a configuration diagram of an image forming apparatus according to a first embodiment.

FIG. 1 is a configuration diagram of the MFP. The MFP 10 includes a main body 11, a scanner part 12, an image processing part 13, a print process part 14, a fixing unit 15, a sheet feed unit 16, a transport mechanism 17, a controller 18, and an operation panel 19.

The scanner part 12 optically scans an original document surface. The scanner part 12 outputs image data as a read image signal. The image processing part 13 corrects the image data.

The print process part 14 forms an image on a sheet, and then outputs the sheet. The fixing unit 15 fixes an unfixed image on the sheet with the help of a heat roller 20 and a press roller 21.

The sheet feeder 16 has two cassettes 22. The sheet feeder 16 feeds the sheets to the print process part 14 with the help of pickup rollers 23.

The transport mechanism 17 includes plural pairs of transport rollers 24, a pair of registration rollers 25, a transfer roller (an after-mentioned transfer unit 40), the heat roller 20, the press roller 21, and a pair of sheet exit rollers 26.

The transport rollers 24 at an upstream side feed one sheet to a sheet path 27 (transport path). The transport mechanism 17 transports the sheet from the upstream side of the fixing unit 15 to a downstream side of the fixing unit 15 through the sheet path 27.

The registration rollers 25 correct skew. As the transport mechanism 17, the transport rollers 24 at the downstream side transports the sheet output by the fixing unit 15. The sheet exit rollers 26 discharge the sheet to a tray 28.

The controller 18 controls the operation of the entire MFP 10. The controller 18 generates a print job. The controller 18 allows the transport mechanism 17 to transport the sheet. The controller 18 allows the print process part 14 to form an image on the sheet.

The controller 18 includes a CPU (central processing unit) 29, a ROM (read only memory) 30, and a RAM (random access memory) 31. The ROM 30 stores a program for allowing the CPU 29 to execute the data processing method of this embodiment therein.

The operation panel 19 has a display 32 and a user interface part 33.

The print process part 14 will be further described.

The print process part 14 includes an image formation part 34 and a laser exposure device 35. The image formation part 34 forms a toner image on an image carrier through the electrophotography. The laser exposure device 35 modulates a laser diode with the image data.

The image formation part 34 includes a photoconductive drum 36, a charging unit 37, a developing unit 38, a toner cartridge 39, a transfer unit 40, and a static eliminator 41.

The photoconductive drum 36 is an image carrier that retains a latent image. The charging unit 37 charges the photoconductive drum 36. The laser exposure device 35 reduces a charge potential of a portion of a surface of the photoconductive drum 36, which is irradiated with a laser beam.

The developing unit 38 develops the latent image formed on the photoconductive drum 36. The toner cartridge 39 is a toner supply device for the developing unit 38. The transfer unit 40 transfers the toner image on the photoconductive drum 36 onto the sheet. The static eliminator 41 eliminates static electricity on the surface of the photoconductive drum 36.

The developing unit 38 has a developer container 42 that is filled with a two-component developer. The developer is made of toner and carrier. The carriers have magnetic properties as toner additives. The developing unit 38 includes a developing roller 43, and augers 44, 45 within the developer container 42.

The developer container 42 includes a chamber (first chamber) 46, a chamber 47, and a wall 48. The wall 48 allows the chambers 46 and 47 to partially communicate with each other.

The chamber 46 has a receive port 67. The receive port 67 is coupled directly to the toner cartridge 39. Alternatively, the receive port 67 is coupled to the toner cartridge 39 through a toner transport path.

The chamber 47 has an opening that faces the photoconductive drum 36. The developing roller 43 is a magnet roller that carries the developer on an outer peripheral surface thereof.

The augers 44 and 45 stir and circulate the developer. The augers 44 and 45 feed the developer to the developing roller 43.

Figure 2:
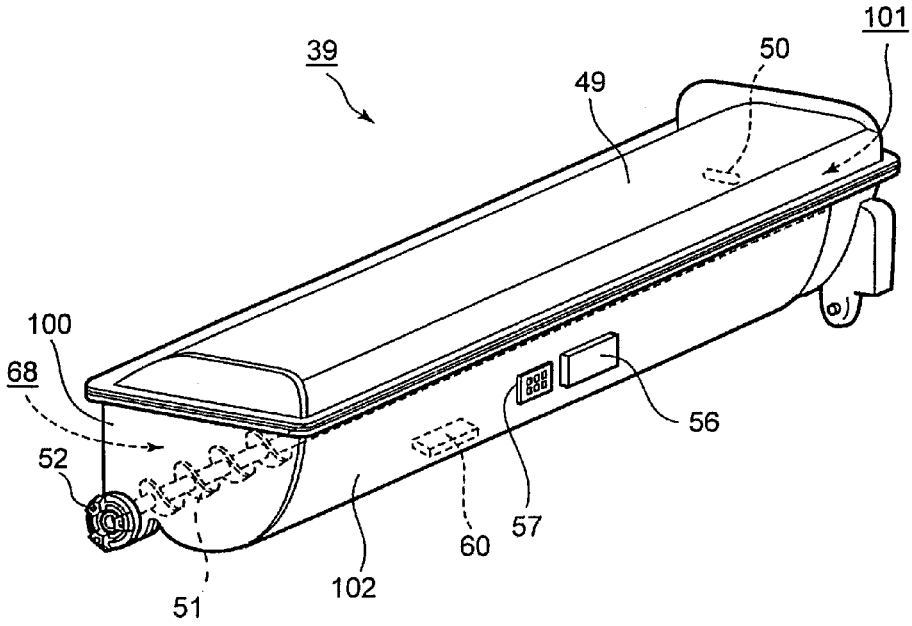
FIG. 2 is a back perspective view of a toner cartridge according to the first embodiment.

FIG. 2 is a back perspective view of the toner cartridge 39. A back surface 100 is at a depth side of the MFP 10. A front surface 101 is at a front of the MFP 10. Reference numerals described above indicate identical elements.

The toner cartridge 39 has a cartridge container 49. The cartridge container 49 has a chamber 68 (second chamber) that contains a supply of toner to the developing unit 38 therein. The toner cartridge 39 has a toner exit port 50.

The toner cartridge 39 has an auger 51 within the cartridge container 49. The toner cartridge 39 receives a drive force for rotating the auger 51 from a coupler 52 in a state where the toner cartridge 39 is set in the main body 11.

The toner cartridge 39 fixes an IC chip (storage medium) 56 to a side surface 102 of the cartridge container 49. The IC chip 56 is equipped with a nonvolatile memory. The IC chip 56 stores the specific data therein. The specific data includes manufacturing records. The IC chip 56 is attached to the cartridge container 49 at the time of manufacturing the toner cartridge 39.

The toner cartridge 39 has a circuit board 57. The circuit board 57 is electrically connected to the IC chip 56. The circuit board 57 has a plurality of terminals. A part of the terminals are covered with paint in advance. Upon setting the toner cartridge 39 in the main body 11, the paint is scraped by contact.

The circuit board 57 has, as one example, an output terminal that outputs a sensor value from a sensor 60, a terminal that outputs the specific data of the IC chip 56, and an input terminal that causes random data recorded in the IC chip 56 instead of the specific data.

The circuit board 57 is electrically connected to a contact point of the main body 11 side in a state where the toner cartridge 39 is set in the main body 11. The circuit board 57 receives a power supply from the main body 11 side. The data of the IC chip 56 is readable and writable by the controller 18.

The toner cartridge 39 has the sensor 60 within the cartridge container 49. The sensor 60 detects the concentration of toner. The toner concentration means a ratio of toner weight to carrier weight. The sensor 60 is formed of a general purpose IC using a piezoelectric element.

The sensor 60 causes the piezoelectric element and toner attached to the piezoelectric element resonate with each other. A resonance frequency of the piezoelectric element to which no toner is attached is higher than a resonance frequency of the piezoelectric element to which toner is attached. A difference between the frequencies is proportional to the amount of toner. The sensor 60 detects the toner concentration according to the amount of toner.

The sensor 60 is also electrically connected to the controller 18 by the circuit board 57 in a state where the toner cartridge 39 is set in the main body 11. The controller 18 always monitors whether toner within the toner cartridge 39 is empty, or not, according to an output of the sensor 60.

The developing unit 38 also has a toner sensor 55 for detecting the toner concentration in the developer container 42. The controller 18 detects that toner within the developing unit 38 is decreased, from the toner sensor 55.

The controller 18 rotationally drives the auger 51 within the toner cartridge 39 in one direction. The cartridge container 49 has a supply path inside. The auger 51 transports toner to the toner exit port 50. The toner cartridge 39 transports toner to the developing unit 38.

A method of eliminating the specific data by the MFP 10 configured as described above will be described with reference to FIGS. 3 and 4.

Figure 3:
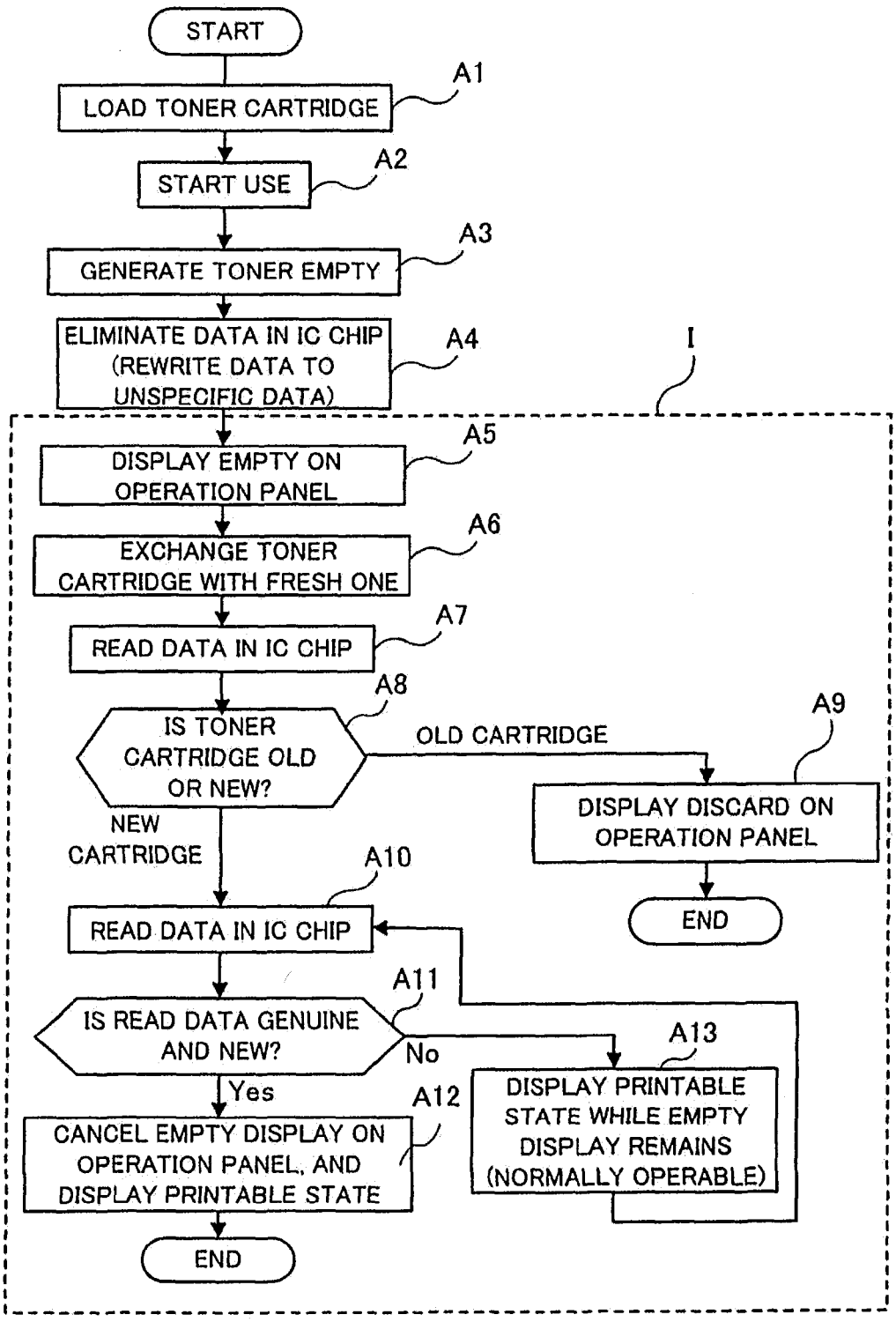
FIG. 3 is a flowchart for describing a method of processing data recorded in a storage medium according to the first embodiment.
Figure 4:
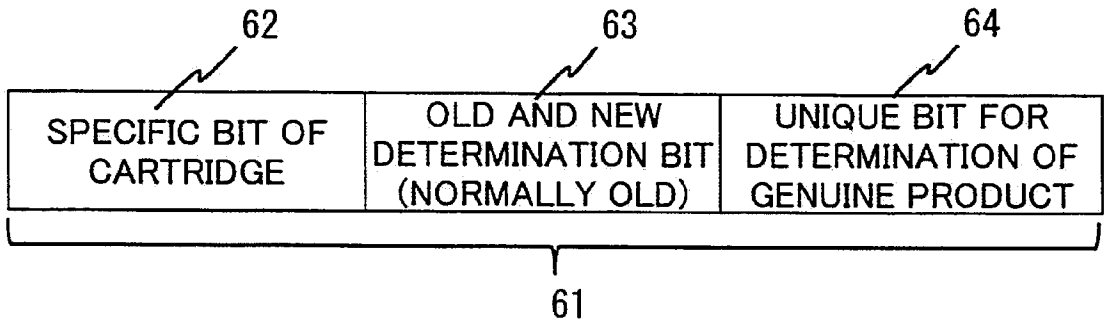
FIG. 4 is a diagram illustrating a data configuration example in the storage medium used in the image forming apparatus according to the first embodiment.

FIG. 3 is a flowchart for describing a method of processing the data recorded in the IC chip 56 of the toner cartridge 39. FIG. 4 is a diagram illustrating a data configuration example within the IC chip 56.

When the IC chip 56 is manufactured prior to Act A1 in FIG. 3, a manufacturing device writes information data specific to the toner cartridge 39 in a storage region 61.

The information data includes, for example, a specific bit 62, an old and new determination bit 63, and a unique bit 64.

The specific bit 62 represents information specific to the toner cartridge 39. The specific bit 62 represents a manufacturing number, manufacture date, a production site, a manufacturer, the amount of toner, a toner color, and a version.

The old and new determination bit 63 represents information for determining whether the toner cartridge 39 is old and new.

If the toner cartridge 39 has never loaded in the MFP 10 yet, the old and new determination bit 63 of the toner cartridge 39 represents "1" (new).

The unique bit 64 represents information for determining whether the toner cartridge 39 is genuine, or not. The unique bit 64 stores, for example, an identification number of a service man allocated to each area therein.

In Act A1 of FIG. 3, the MFP 10 loads the toner cartridge 39 filled with toner in the main body 11.

In Act A1, the controller 18 reads the IC chip 56. The controller 18 recognizes that the toner cartridge 39 is new, according to the old and new determination bit 63 indicative of "1".

After recognition, the controller 18 rewrites the old and new determination bit 63 to "0" (old).

In Act A1, the controller 18 ensures all or a part of a region of the unique bit 64 for a counter for the number of prints. The controller 18 may write use history information such as the number of toner supply or a rotating speed of the auger 51 in the region.

In Act A2, the MFP 10 starts the use of the toner cartridge 39. The MFP 10 inserts a plurality of original documents into an automatic document feeder 65.

The automatic document feeder 65 repetitively feeds the original documents. The scanner part 12 repetitively generates image data for each page. The RAM 31 accumulates the image data for each page therein. The transport mechanism 17 transports the sheets one after another. The print process part 14 prints and outputs the sheets.

The transport mechanism 17 transports the sheets at time intervals one after another. The controller 18 increments a print counter of the IC chip 56 every time print is conducted.

During operation of the MFP 10, the controller 18 monitors the toner concentration of the toner cartridge 39 through the sensor 60.

In Act A3, if the toner concentration from the sensor 60 is smaller than a threshold value retained in advance, the controller 18 detects the occurrence of the toner empty.

In Act A4, the controller 18 eliminates the data in the IC chip 56.

Figure 5:
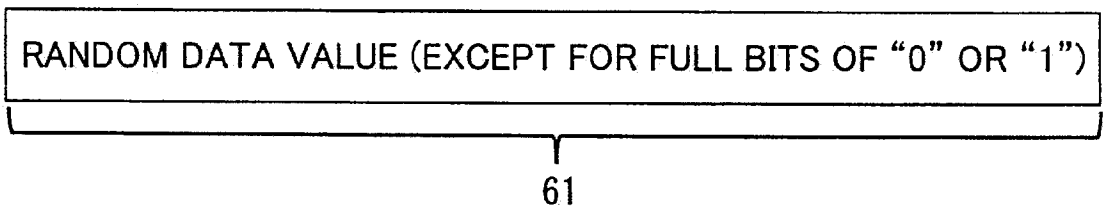
FIG. 5 is a diagram illustrating a data configuration example in the storage medium at the time of detecting toner empty.

FIG. 5 is a diagram illustrating a data configuration example within the IC chip 56 at the time of detecting toner empty.

Upon reading empty from the sensor 60, the controller 18 rewrites the data in the IC chip 56 to random data.

The random data represents a bit string of any bit pattern except for a bit pattern in which all of bit values are "0", and a bit pattern in which all of bit values are "1".

Write of the random data prevents a person different from a manufacturer of the genuine toner cartridge 39 from specifying the data in the IC chip 56.

In Act A5, the controller 18 displays the toner empty on the operation panel 19. The display of the operation panel 19 prompts an operator to exchange the toner cartridge 39 with a fresh one. The operator exchanges the toner cartridge 39 with a fresh one.

In Act A6, the controller 18 detects the exchange of the toner cartridge 39. In Act A7, the controller 18 reads the data in the IC chip 56.

In Act A8, the controller 18 determines whether the set toner cartridge is old or new, according to the value of the old and new determination bit 63 of the read data.

In Act A8, if the old and new determination bit 63 represents "0", the controller 18 determines that the toner cartridge is old.

The controller 18 pass through a route of "old cartridge", and in Act A9, the controller 18 displays that the toner cartridge should be discarded, on the operation panel 19.

In Act A8, if the old and new determination bit 63 represents "1", the controller 18 determines that the toner cartridge 39 is new.

The controller 18 passes through a route of "new cartridge", and in Act A10, the controller 18 reads the data in the IC chip 56.

In Act A11, the controller 18 determines whether the toner cartridge 39 is genuine and new, or not, according to the read data.

Figure 6:
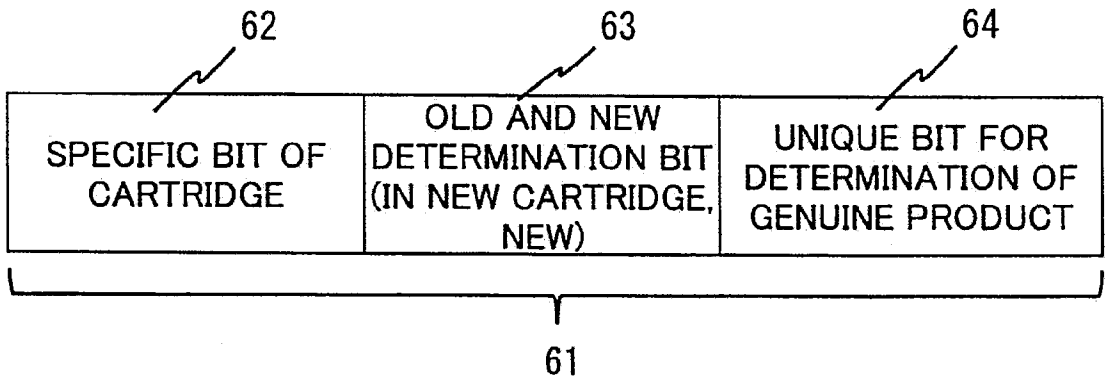
FIG. 6 is a diagram illustrating a data configuration example in a fresh storage medium.

FIG. 6 is a diagram illustrating a data configuration example within the IC chip 56 of the new toner cartridge. The symbols described above represent identical elements.

In Act A11, the controller 18 determines that information of which the genuine manufacturer has knowledge is recorded in the unique bit 64, and that the old and new determination bit 63 represents "1".

Based on the determination result in Act A11, the controller 18 determines that the toner cartridge 39 is new and genuine. The controller 18 passes through a route of yes, and allows the operation panel 19 to cancel the empty display in Act A12.

In Act A12, the controller 18 allows the operation panel 19 to display a printable state.

After Act A11 or A12, the controller 18 rewrites the old and new determination bit 63 to "0" (old).

In Act A11, if the controller 18 determines that the toner cartridge 39 is new but not genuine, the controller 18 passes through a route of no, and allows the operation panel 19 to continue the empty display in Act A13.

The operation panel 19 blinks, for example, a red lamp indicative of empty.

Thereafter, the controller 18 returns to processing in Act A10, and again reads the data in the IC chip 56.

If control is conducted in a loop of Acts A10, A11, and A13, the controller 18 allows the operation panel 19 to continuously display that normal print operation is enabled.

The MFP 10 eliminates the data within the IC chip 56 as soon as the toner empty occurs. When toner is used up, and the user is going to exchange the toner cartridge 39 with a fresh one, the data has already been eliminated.

When the user exchanges the toner cartridge 39, even if the user prepares a dedicated reader machine, the dedicated reader machine cannot read the data.

When toner becomes empty, the data within the IC chip is rewritten to the random data before the toner cartridge 39 is removed from the main body 11. Ungenuine products or recycled products cannot be manufactured manufacturers other than the genuine manufacturer.

All the bit values of the bit pattern are all "0" or all "1" is assumed. A person who is going to replicate data senses that data is rewritten by a dedicated reader machine. Writing of the random data prevents even data rewriting from being sensed.

Ungenuine manufacturers cannot read the data with the help of the dedicated reader machine, and replicate the read data in another IC chip. A third party cannot attach the IC chip in which genuine data has been recorded to a toner cartridge made by the third party. The third party is difficult to replicate and manufactures the genuine toner cartridge.

In general, as products of the toner cartridges, there are genuine products and the ungenuine products. As the products of the toner cartridges, there are new products and recycled products.

A quality of the genuine toner cartridge 39 made by the manufacturer of the MFP 10 is higher than that of the toner cartridge manufactured by the third party. The genuine toner cartridge 39 brings out the performance of the MFP 10 at a maximum.

The controller 18 rewrites date to the random data before the operation panel 19 displays the data. The data in the IC chip 56 is not displayed. Specific information data is not leaked from the manufacture to the external.

If the information data is eliminated after the information data has been displayed on the operation panel, the information data is leaked from the manufacturer to the external. No specific data is leaked in the MFP 10. The information data acquired by a person with a bad intension is not copied in an IC chip.

The ungenuine manufacturer cannot replicate the ungenuine toner cartridge or the recycled toner cartridge.

Second Embodiment

The example of the above first embodiment is the best mode. The person with a malicious intention attempts to detach the toner cartridge 39 from the main body 11, and read the data within the IC chip 56 before toner empty occurs.

An image forming apparatus according to a second embodiment eliminates the data within the IC chip 56 before the toner empty occurs.

In the image forming apparatus according to the second embodiment, the ROM 30 stores a program of processing executed by the CPU 29 therein, which is different from a program of the processing in the first embodiment.

The image forming apparatus according to this embodiment is the MFP 10. The MFP 10 is substantially identical with that in the first embodiment.

A cartridge according to this embodiment is the toner cartridge 39.

A method of processing the data according to this embodiment is a method of eliminating specific data recorded in the IC chip 56.

Figure 7:
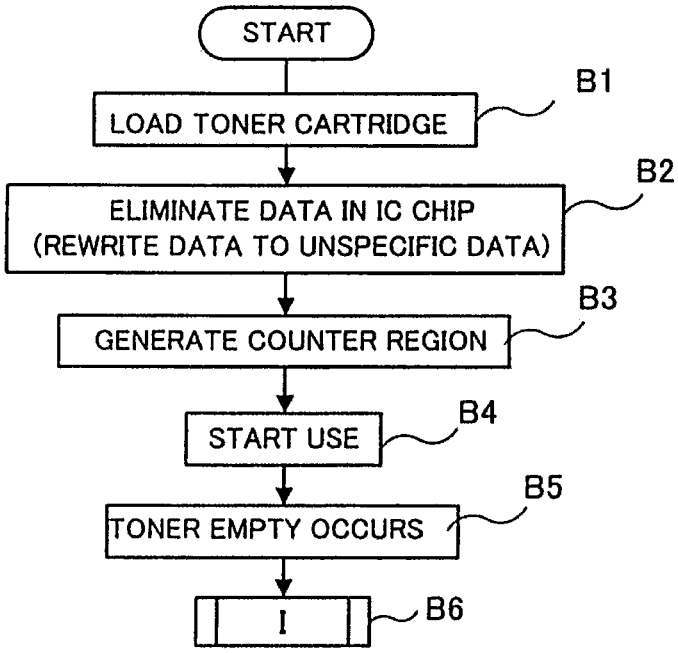
FIG. 7 is a flowchart for describing a method of processing data recorded in a storage medium according to a second embodiment.

FIG. 7 is a flowchart for describing a method of processing the data recorded in the IC chip 56 of the toner cartridge 39 according to the second embodiment.

In Act B1, the MFP 10 is equipped with the toner cartridge 39 filled with toner. The old and new determination bit 63 of the IC chip 56 indicates new.

In Act B2, the controller 18 reads the IC chip 56. The controller 18 recognizes that the toner cartridge 39 is new. The controller 18 rewrites the data to the random data. The data in the IC chip 56 is eliminated.

In Act B3, the controller 18 generates a counter for the number of prints in a region of the unique bit 64.

In Act B4, the MFP 10 starts the use of the toner cartridge 39. The MFP 10 repeats a print output. The controller 18 monitors the toner concentration of the toner cartridge 39.

In Act B5, the controller 18 detects the occurrence of toner empty.

Thereafter, the controller 18 executes substantially the same processing as processing denoted by I in FIG. 3.

Subsequently, the toner cartridge 39 is new and genuine. The controller 18 allows the operation panel 19 to cancel empty display. The controller 18 allows the operation panel 19 to display a printable state.

The controller 18 eliminates the data immediately after the toner cartridge 39 has been loaded into the main body 11 of the MFP 10. Even if the user detaches the toner cartridge 39 from the main body 11 before toner is empty, the user can no longer read the data.

The ungenuine manufacturer cannot replicate the ungenuine toner cartridge or the recycled toner cartridge.

Modified Example

The sensor 60 may be formed of a sensor that measures a magnetic permeability. The sensor 60 includes an oscillator circuit that generates a magnetic flux, and a coil circuit that detects a magnetic flux density that is changed according to the amount of magnetic carrier. The sensor 60 detects the toner concentration with a change in the magnetic permeability.

The sensor 60 may be formed of a sensor that detects the transmittance of light. The sensor 60 includes a light emitting element, a window in a developer, and a photo transistor that receives a transmitted light among an illuminating light. The sensor 60 detects the toner concentration with a change in the amount of received light.

The storage medium may be formed of an RFID (radio frequency identification) tag instead of the IC chip 56. The MFP 10 has a noncontact data read and write device within the main body 11.

The read and write device transmits and receives data with respect to the controller 18. After the toner cartridge 39 is set in the MFP 10, the read and write device reads information from the RFID tag, and eliminates data of the RFID.

Others

The image forming apparatus may be a printer or a copying machine.

The image forming apparatus may be an MFP, a printer, or a copying machine of colors. The image forming apparatus includes respective developing units of yellow (Y), magenta (M), cyan (C), and black (K), and toner cartridges for colors of the respective developing units.

A configuration and a structure of the toner cartridge 39 in FIG. 2 is one example, and the configuration and the structure can be changed. The advantages of the image forming apparatus according to this embodiment are not impaired by products that merely change the configuration and the structure.

The data structure of the IC chip 56 is not limited to the example of FIG. 4. In the image forming apparatus according to this embodiment, the expressions and the bit regions of the specific bit 62, the old and new determination bit 63, and the unique bit 64 can be changed.

The image forming apparatus can use any data structure.

For example, the image forming apparatus may discriminate the old and new determination bit by a fuse element. The fuse element is melted by a limit current. The controller 18 may cut the fuse element by the circuit board 57 when rewrite is conducted from new to old.

The controller 18 may include a code generator that generates the random data. The code generator generates the random data with the use of date and time. The code generator obtains a bit pattern that cannot be specified by a person different from the genuine manufacturer.

While certain embodiments have been described, these embodiments have been presented by way of example only, and are not intended to limit the scope of the inventions. Indeed, the novel methods and systems described herein may be embodied in a variety of other forms; furthermore various omissions and substitutions and changes in the form of methods and systems described herein may be made without departing from the spirit of the inventions. The accompanying claims and their equivalents are intended to cover such forms or modifications as would fall within the scope and spirits of the inventions.

What is claimed is:

1. An image forming apparatus, comprising:

a photoconductive drum on which an electrostatic latent image is formed;

a container having a first chamber that contains a developer made of toner and a carrier, and a receive port in communication with the first chamber;

a developing roller configured to develop the electrostatic latent image on the photoconductive drum with toner from the container;

a toner cartridge having a second chamber that contains a supply of toner, and a discharge port in communication with the second chamber, the toner cartridge configured to transport toner from the discharge port to the receive port in the container;

a rewritable storage medium fixed to the toner cartridge and configured to store specific data therein, the specific data uniquely identifying the toner cartridge and indicating whether the toner cartridge is old or new;

a sensor configured to detect a toner amount in the toner cartridge; and a controller configured to determine whether the toner cartridge is indicated as old or new according to the specific data, and to store random data as the specific data in the rewritable storage medium if the controller determines that the toner cartridge is indicated as new.

2. The apparatus of claim 1, wherein the random data does not include a bit pattern in which bit values of all bits are identical with each other.

3. The apparatus of claim 1, wherein the rewritable storage medium includes a first subregion for storing determination data indicating whether the toner cartridge is old or new, and the controller is configured to read the determination data from the first subregion to determine whether the toner cartridge is indicated as old or new.

4. The apparatus of claim 1, wherein the controller is configured to write to the rewritable storage medium counter data indicating a number of prints, after storing the random data as the specific data.

5. The apparatus of claim 1, wherein the rewritable storage medium includes a first subregion for storing data indicating whether the toner cartridge is old or new, and a second subregion for storing data indicating whether the toner cartridge is genuine or not.

6. The apparatus of claim 5, wherein the controller is configured to control a display on an operation panel according to the data stored in the first and second subregions.

7. The apparatus of claim 1, wherein the sensor is configured to detect the toner amount according to one of: vibration of a piezoelectric element, a magnetic permeability, and a light transmittance.

8. A method of processing data recorded in a rewritable storage medium, comprising:

detecting that a toner cartridge is loaded in an image forming apparatus, the toner cartridge including a rewritable storage medium that stores specific data that uniquely identifies the toner cartridge and indicates whether the toner cartridge is old or new;

determining that the toner cartridge is indicated as new based on the specific data;

detecting a toner amount in the toner cartridge; and rewriting the specific data stored in the rewritable storage medium with random data, based on the determination that the toner cartridge is indicated as new.

9. The method of claim 8, wherein the random data that is rewritten does not include a bit pattern in which bit values of all bits are identical with each other.

10. The method of claim 8, further comprising:

after rewriting the specific data with random data, detecting that a second toner cartridge has been loaded in the image forming apparatus;

determining that the second toner cartridge is indicated as old according to specific data of the second toner cartridge; and displaying instructions to discard the second toner cartridge on an operation panel based on the determination that the toner cartridge is indicated as old.

11. The method of claim 8, further comprising:

after rewriting the specific data with random data, detecting that a second toner cartridge has been loaded in the image forming apparatus;

determining that the second toner cartridge is indicated as genuine according to specific data of the second toner cartridge; and displaying a printable state on an operation panel based on the determination that the toner cartridge is indicated as genuine.

12. The method of claim 8, further comprising:

after rewriting the specific data with random data, detecting that a second toner cartridge has been loaded in the image forming apparatus;

determining that the second toner cartridge is indicated as ungenuine according to specific data of the second toner cartridge; and displaying a toner empty indication on an operation panel based on the determination that the toner cartridge is indicated as ungenuine.

13. The method of claim 8, further comprising:

writing to the rewritable storage medium counter data indicative of a number of prints, after rewriting the specific data with random data.

14. The method of claim 8, further comprising:

detecting a toner amount according to one of: vibration of a piezoelectric element, a magnetic permeability, and a light transmittance.

* * * * *